US007931834B2

(12) United States Patent
Mehta et al.

(10) Patent No.: US 7,931,834 B2
(45) Date of Patent: Apr. 26, 2011

(54) PROCESS FOR FORMATION AND COLLECTION OF PARTICLES USING CRYOGENIC MATERIAL

(75) Inventors: Rajesh V. Mehta, Rochester, NY (US); Robert Link, Webster, NY (US); Michael A. Marcus, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 1108 days.

(21) Appl. No.: 11/674,291

(22) Filed: Feb. 13, 2007

(65) Prior Publication Data

US 2008/0190323 A1 Aug. 14, 2008

(51) Int. Cl.

| | |
|---|---|
| ***B29B 9/00*** | (2006.01) |
| ***B22F 9/00*** | (2006.01) |
| ***B22F 9/02*** | (2006.01) |
| ***B22F 9/06*** | (2006.01) |

(52) U.S. Cl. ..... 264/5; 75/331; 427/457

(58) Field of Classification Search ..... 106/285, 106/286.1–286.7; 264/5; 427/457; 75/331
See application file for complete search history.

(56) References Cited

U.S. PATENT DOCUMENTS

| | | | | |
|---|---|---|---|---|
| 5,203,843 | A | 4/1993 | Hoy et al. | |
| 5,766,061 | A | 6/1998 | Bowers | |
| 6,500,758 | B1 | 12/2002 | Bowers | |
| 6,630,121 | B1 | 10/2003 | Sievers et al. | |
| 2005/0263170 | A1 | 12/2005 | Tannous et al. | |
| 2005/0272347 | A1 | 12/2005 | Spalteholz et al. | |
| 2006/0041248 | A1 * | 2/2006 | Patton et al. | 604/890.1 |

OTHER PUBLICATIONS

S. M. Rossnagel; IBM Journal of Research and Development; Jan.-Mar. 1999; "Sputter Deposition for Semiconductor Manufacturing".

* cited by examiner

*Primary Examiner* — Jerry Lorengo
*Assistant Examiner* — Jared Wood
(74) *Attorney, Agent, or Firm* — Andrew J. Anderson

(57) ABSTRACT

A process for the formation of particles of a target material is disclosed, comprising: (i) introducing the target material into a particle formation vessel, and forming a continuous liquid surface of the target material in the particle formation vessel, and an interface between said liquid surface of the target material and additional gaseous contents of said particle formation vessel; (ii) introducing a stream of cryogenic material including solid particles of cryogenic material into the particle formation vessel and into contact with the target material in a liquid state below the continuous liquid surface; (iii) allowing rapid volumetric expansion of the cryogenic material into a gaseous state while in contact with the target material in a liquid state, and release of the expanded gaseous cryogenic material through the continuous liquid surface, and forming liquid droplet particles of the target material; and (iv) collecting the formed particles of the target material.

19 Claims, 6 Drawing Sheets

PROCESS FOR FORMATION AND COLLECTION OF PARTICLES USING CRYOGENIC MATERIAL

FIELD OF THE INVENTION

This invention relates generally to the controlled formation of particles of a target material, and dispersions and films formed from such particles using cryogenic materials.

BACKGROUND OF THE INVENTION

Sputter deposition is one of the most widely used techniques for the fabrication of metal or metal oxide thin-film structures on substrates such as semiconductor wafers or glass or plastics. Sputter deposition is the deposition of particles vaporized from a surface (sputter target) by the physical sputtering process. A review of sputter deposition process is available entitled "Sputter Deposition For Semiconductor Manufacturing" by S. M. Rossnagel in *IBM J. of Research & Development,* 43, 163 (1999). Physical sputtering is a non-thermal vaporization process where surface atoms are physically ejected by momentum transfer from an energetic bombarding particle that is usually a gaseous ion accelerated from plasma or an "ion gun." A plasma is a gaseous environment where there are enough ions and electrons for there to be appreciable electrical conductivity. Vacuum deposition is the deposition of a film or coating in a vacuum (or low-pressure plasma) environment. Generally, the term is applied to processes that deposit atoms or molecules one at a time.

Sputter deposition is usually carried out in diode plasma systems known as magnetrons. It is usually performed in a vacuum or low-pressure gas (<5 mTorr) where the sputtered particles do not suffer gas-phase collisions in the space between the target and the substrate. It can also be done in a higher gas pressure (5-15 mTorr) where energetic particles that are sputtered or reflected from the sputtering target are "thermalized" by gas-phase collisions before they reach the substrate.

Cryogenic solids are solids that only form at very low temperatures. Cleaning of surfaces utilizing impingement of cryogenic solid particles of relatively inert gases such as argon and $CO_2$ are known. The size of the material removed is much larger than in physical sputtering. An example of a conventional carbon dioxide cleaning system is described in U.S. Pat. No. 5,766,061 entitled "Wafer Cassette Cleaning Using Carbon Dioxide Jet Spray" by Charles W. Bowers. More recent examples of methods and apparatus employing the process are found in U.S. 20050263170 entitled "Methods For Resist Stripping And Other Processes For Cleaning Surfaces Substantially Free Of Contaminants" by A. Tannous and K. Makhamreh and U.S. 20050272347 entitled "Dry Ice Blasting Cleaning Apparatus" by B. Spalteholz and G. Nielsen.

U.S. 20050263170 suggests that the combination of sublimation of a spray of cryogenic solid particles as they impinge the surface to be cleaned, and the impact momentum transfer by the particles, provide the vehicle for removing contamination from a surface. It further suggests that sublimation occurs, and therefore a major portion of the cleaning, only while the surface to be cleaned is at a higher temperature than that of the cryogenic solid spray. The thermophoresis due to the heated surface also helps to remove the particles from the surface and reduce the chance for re-deposition of the detached particles. As a consequence, heating of the surface being cleaned preferably is required within the vicinity of the impinging cleaning spray.

Carbon dioxide snow lift-off process has also made sputter metal process more reliable in semiconductor wafer manufacturing. U.S. Pat. No. 6,500,758 entitled "Method For Selective Metal Film Layer Removal Using Carbon Dioxide Jet Spray" by Charles W. Bowers describes a method for selective metal film layer removal using carbon dioxide jet spray. The $CO_2$ snow lift-off removes the unwanted metal from the wafer by initiating a thermal expansion mismatch between the metal layer and the photoresist. This causes the metal to crack and delaminate at the photoresist interface. The loosened metal is then carried off the wafer surface by the $CO_2$ snow.

U.S. Pat. No. 6,630,121 entitled "Supercritical Fluid-Assisted Nebulization And Bubble Drying" by Sievers et al. describes a method of making fine particles of a substance by forming a composition comprising a substance of interest and a supercritical or near supercritical fluid; rapidly reducing the pressure on said composition, whereby droplets are formed; and passing said droplets through a flow of heated gas. This approach requires the mixing of the substance to be made into fine particles with a high-pressure fluid and further use of a heated gas after the pressure is rapidly reduced. It would be desirable to enable controlled particle formation of a target material without the need of mixing the target material with a supercritical or near supercritical fluid in a high-pressure chamber.

Spray coating is another well-known process that involves passing a coating formulation under pressure through an orifice in to air in order to form a liquid spray that impacts a substrate and forms a liquid coating on the substrate. An example of spray coating is provided in U.S. Pat. No. 5,203,843, entitled "Liquid Spray Application of Coatings With Supercritical Fluids As Diluents And Spraying From An Orifice" by Kenneth L. Hoy et al. Hoy et al. describe a process of forming a liquid mixture in a closed system, said liquid mixture comprising at least one polymeric component capable of forming a coating on a substrate and a solvent component containing at least one supercritical fluid and spraying said liquid mixture onto a substrate to form a liquid coating thereon, by passing the mixture under pressure through an orifice into the environment of the substrate to form a liquid spray. This approach also requires the mixing under high-pressure which is undesirable.

It would also be desirable to enable controlled particle formation of a target material, and formation of films and dispersions from such particles, without the need for low-pressure systems such as employed in conventional sputter deposition systems. Use of cryogenic particles to controllably make fine particles, dispersions, or films from a target material has not been reported to date.

SUMMARY OF THE INVENTION

In accordance with one embodiment, the invention is directed towards a process for the formation of particles of a target material comprising:

(i) introducing the target material into a particle formation vessel, and forming a continuous liquid surface of the target material in the particle formation vessel, and an interface between said liquid surface of the target material and additional gaseous contents of said particle formation vessel;

(ii) introducing a stream of cryogenic material containing particles into the particle formation vessel and into contact with the target material in a liquid state below said interface;

(iii) allowing rapid volumetric expansion of the particles of the cryogenic material into a gaseous state while in contact with the target material in a liquid state, and releasing the expanded gaseous cryogenic material through said interface while forming liquid droplet particles of the target material; and (iv) collecting the formed particles of the target material.

In accordance with a various embodiments, the target material may be heated in the particle formation vessel to a temperature above the target material's melting point to form a continuous liquid surface of the target material having an interface with the gaseous contents of said particle formation vessel, or the target material may be directly introduced into the particle formation vessel in a liquid state, and the temperature of the target material may be controlled in the particle formation vessel to keep it in a liquid state.

In accordance with still further embodiments, the invention is also directed towards a dispersion of particles of a target material, and films of a target material produced by the process of the invention.

BRIEF DESCRIPTION OF THE DRAWINGS

In the detailed description of the preferred embodiments of the invention presented below, reference is made to the accompanying figures, in which.

DETAILED DESCRIPTION OF THE INVENTION

In accordance with this invention, it has been found that fine particles of a desired substance can be controllably prepared by introduction of a stream of cryogenic material, including particles of cryogenic material, into contact with a target material in a liquid state below a continuous liquid surface of the target material, causing rapid volumetric expansion of the cryogenic material into a gaseous state while in contact with the target material in a liquid state, and releasing the expanded gaseous cryogenic material through the continuous liquid surface, forming liquid droplet particles of the target material carried along with the gas as described herein. The liquid droplets may quickly solidify, and such solid particles of target material may be collected. If solidification does not occur, liquid droplet particles also may be collected. Unless specified, the term "particles" includes both liquid and solid particles.

Figure 1:
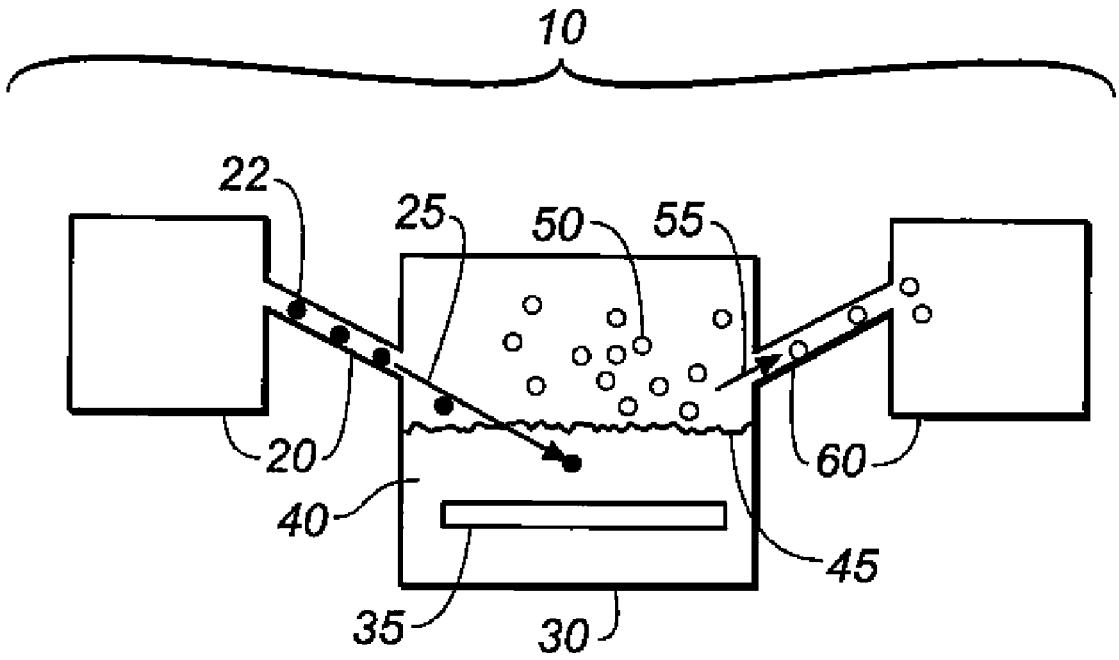
FIG. 1 is a schematic of a first embodiment of particle formation and collection apparatus used to carry out this invention.

FIG. 1 shows a schematic of a first embodiment of a particle formation and collection apparatus useful in carrying out this invention. The apparatus 10 consists of a cryogenic material source 20, a particle formation vessel 30 with an optional heating element 35, and a target material collection device 60. Target material 40 is loaded into the particle formation vessel 30 and is heated above its melting point Tm if required. A gas-liquid interface 45 is formed inside the particle formation vessel 30. During operation, a stream containing cryogenic particles 25 is first introduced into the particle formation vessel 30. Cryogenic material particles 22 in the stream 25 are contacted with the target material 40 through the gas-liquid interface 45. The rapid expansion of cryogenic particles 22 causes formation of bubbles of cryogenic material that rise through the target material 40 and leads to the formation of fine particles of target material 50. The released gas carries the fine particles of the target material 50 as a stream 55 to the particle collection device 60.

The target material may comprise any material that has a liquid like behavior above a certain temperature without undergoing significant chemical changes. The liquid viscosity and surface tension of the target material may be controlled such that the cryogenic particles are able to penetrate into the liquid and expand very rapidly. The target material may include a very wide range of metals such as indium, tin, lead, bismuth, antimony, aluminum, copper, gold, silver, platinum and composites thereof. The target material may also comprise any pure liquid, liquid solution, or mixture or dispersion of material in liquid solvents. Materials of a desired substance prepared in accordance with the invention may also be of the types such as organic (including metallo-organic), inorganic, polymeric, oligomeric, ceramic, metallo-ceramic, a synthetic and/or natural polymer, and a composite material of these previously mentioned. Materials can be, for example colorants (including dyes and pigments), agricultural chemicals, commercial chemicals, fine chemicals, pharmaceutically useful compounds, food items, nutrients, pesticides, photographic chemicals, explosive, cosmetics, protective agents, metal coating precursor, or other industrial substances whose desired form is that of fine particles, their dispersions, or their coatings or films. The process of the invention is also applicable to the preparation of particles of a wide variety of materials for use in, e.g., pharmaceutical, agricultural, food, chemical, imaging (including photographic and printing, and in particular inkjet printing), cosmetics, electronics (including electronic display device applications, and in particular printing of conducting elements on rigid or plastic substrates), data recording, catalysts, polymer (including polymer filler applications), pesticides, explosives, and microstructure/nanostructure architecture building, all of which can benefit from use of small particulate materials, their dispersions, coatings or films.

Particle formation vessels employed in the present invention include means for controlling and/or heating a target material to a temperature above the target material's melting point to form a continuous liquid surface of the target material, and means for introducing a stream of cryogenic material including solid particles of cryogenic material into the particle formation vessel and into contact the target material in a liquid state below the continuous liquid surface.

In addition to the first embodiment of a particle formation vessel shown in FIG. 1, the particle formation vessel may also be comprised of a heated tube or an open chamber with a heat source to heat the top surface of the target material. In one embodiment, target material may be placed into a heated particle generation vessel, and heat may be applied so that the entire mass of the target material is kept above its melting point throughout the particle generation process. In another embodiment, the target material may be prepared as a thin film on a surface of the particle generation vessel. Any of the known technologies for thin film formation may be employed including electrodeposition, vacuum deposition, spin coating, spray coating, web or dip coating, and inkjet printing. The surface with the film may be electrically heated during the particle generation process. It is also envisioned that target material may be introduced into the particle formation vessel as part of a continuous flow system, where at least a portion of the target material flow stream is exposed to the cryogenic particles. In a continuous particle formation system, both cryogenic material and target material may be introduced into the particle formation at a rate substantially equal to the rate at which they are removed from it. All of these particle formation vessels can operate under atmospheric conditions or near atmospheric pressures.

In practicing this invention, cryogenic material may include neon, xenon, argon, methane, nitrogen, hydrogen, carbon dioxide, and their suitable mixtures. When permissible, carbon dioxide is a preferred material because of its lower cost.

Cryogenic particles may be generated and introduced into the particle formation vessel by any of the well-known means. One preferred method is taking a cryogenic fluid at high pressure and expanding it through a nozzle or a manifold. The large cooling effects that accompany expansion along with pressure reduction will solidify or liquefy the cryogenic fluid. The influence of the shape and size of the expansion zone, and its temperature field on the cryogenic particle size is well understood in the art. Cryogenic particle size is preferably controlled to a desired size so that the disclosed process forms corresponding sized target material particles. The size of the solidified target material particles depends on dynamic interactions of flow and temperature fields with particle nucleation and growth processes. For the generation of cryogenic liquid particles, well-known methods of forming liquid spray may be employed, such as ultrasonic nebulization.

The cryogenic particles are transported from their source to the surface of the target material that is in liquid state. This may be done with means comprising a carrier gas traveling in free space or through a conduit. The size of the cryogenic particles may change during that passage either due to aggregation or due to phase change or both. The carrier gas may be made up of the same material as the cryogenic particles. This could be the case when using compressed $CO_2$ as the cryogenic fluid. The generation and transport of the cryogenic particles is preferably controlled so that the average size of the cryogenic particles at the point of contact with the target material is below 10 micron, more preferably below 1 micron, most preferably below 0.1 micron.

The cryogenic particles are next introduced below the liquid surface of the target material. This can be accomplished in a number of ways. In one embodiment, momentum of the cryogenic particles is used to penetrate the liquid surface. The size and velocity of the cryogenic particles is preferably controlled such that large or observable splashes of liquid are avoided. In another embodiment, a transport conduit or manifold may be submerged below the liquid surface and the particle stream entered directly into the target liquid. In both embodiments, the cryogenic particles preferably are introduced to a depth such that the subsequent phase change and rapid expansion of those particles occur below the surface of the target material. The heat transfer dynamics in the cryogenic particle introduction region are controlled such that cryogenic particles are indeed able to enter into the target material. In one preferred embodiment, the target material may be kept heated by an electric heater and its temperature controlled. A variety of heating means for target material may be applied including, e.g., Infra Red, Microwave, and Induction heaters on the one hand, and temperature controlling fluid heaters on the other.

Without being bound by any theory, we suggest that upon introduction into the target liquid, the cryogenic particles rapidly undergo phase change consistent with local thermodynamic and kinetic conditions. This leads to a rapid change in the volume, and hence, in the density of the cryogenic particle mass. The rapidly expanding mass of the cryogenic gas has a liquid film of target material enveloped around it. With continued expansion and pressure differences changes, the liquid film breaks and disintegrates into fine droplets of liquid target material. In general, formation of target material particles smaller than 10 microns are preferred, particles smaller than 1 micron are more preferred, and particles smaller than 0.1 micron are the most preferred. These target material particles are entrained by the gaseous flow in the particle formation vessel.

The liquid droplets of target material may be transported to a collection region. In a particular embodiment, a gaseous flow containing particles of the target material entrained in a carrier gas may be exhausted from the particle formation vessel, wherein the particles of the target material are collected from the gaseous flow. The carrier gas may comprise cryogenic material that is in a gaseous state, and/or a distinct carrier gas added to the particle formation vessel. Depending on the distance between the region of droplet generation and the region of their collection, the transport may be dominated by the momentum of the droplets or by the momentum of the carrier gas. The droplets may also cool off during this process sufficiently to become solid particles of the target material.

The collection of the particles generated by the disclosed process can be accomplished in a number of different ways, employing a variety of different possible means for collecting particles of the target material formed upon rapid volumetric expansion of the cryogenic material into a gaseous state. In one embodiment, feeding the exhaust of particle generation vessel into a suitable collection system allows collection of the generated particles. The collection system may consist of various dry particle collection means including filters, electrostatic precipitators, and impactor plates. Alternately, the collection system may produce a wet product where the exhaust stream is bubbled through a liquid medium wherein the solid particles are captured. Depending on the intended use, the captured particles may have very low solubility in the liquid, may react with one or more components of that liquid, or may adsorb dispersants available in that liquid. In all these cases a dispersion of generated particles may be obtained with or without additional modifications. In yet another embodiment, the exhaust stream is allowed to impinge on a moving or stationary substrate onto which the particles adhere themselves. By controlling the distance of the substrate from the exhaust manifold, the temperature of the substrate, and the local flow field of the impinging jet, it is possible to create a coating of desired particle loading or a continuous film of desired thickness. In certain embodiments of the invention, when the size of the formed particles of the target material is sufficiently small (e.g., less than 50 nm and especially less than 10 nm), the formed particles may sinter at a temperature substantially below the bulk melting point of the target material, and the particles of the target material may form a continuous film upon contact with the substrate at a temperature of the gaseous flow lower than the melting point of the bulk target material. The invention further advantageously enables thin material films to be deposited at ambient or near ambient (e.g., within 10 percent of ambient) conditions of pressure.

EXAMPLES

Example 1

A surface coated with an organic compound was prepared as follows. A continuous flow stream consisting of carbon dioxide, acetone, and particles of Tert-Butyl-anthracene dinaphthylene (TBADN: a functional material used in Organic Light Emitting Diodes) at atmospheric pressure was continuously heated by a flow-through gas heater (Omega Inc., Model AHPF-101, 8 inch heated length, 0.152 sq in cross section area) for several hours. At the end of that duration, the internal wall of the heater was found to be coated with TBADN. The heater feed port was then connected to a nominally pure carbon dioxide source pressurized to 100 bar. Carbon dioxide mass flow rate was set at 50 g/min. The flow passed through a needle valve prior to entering the heater, and the pressure drop across the needle valve was 100 bar. This created a mixture of solid carbon dioxide particles in a cold carrier gas of carbon dioxide. A Scanning Mobility Particle Sizer (SMPS) (TSI Model 3936) was used to measure the average steady state concentration and size of carbon dioxide particles online. The number concentration at the inlet of the heater was $2.37\times10^{6}$ $cm^{-3}$ and the size was about 45 nm. Due to the annular flow between the heater feed port and exit port, the solid carbon dioxide particles impinge upon the internal walls of the heater between the two ports. The heater was heated to various wall temperatures, as reported in Table 1. Melting point of TBADN powder is 289° C. Vapor pressure of TBADN at 300° C. is $3.15\times10^{-5}$ bar and at 400° C., it is $6.7\times10^{-3}$ bar. The steady state number concentration and size of particles exiting the heater were measured as heater wall temperature was increased. The results are listed in Table 1.

TABLE 1

| Heater Wall Temperature (° C.) | Average Number Concentration of Particles Exiting the Heater ($cm^{-3}$) | Average Size of Particles Exiting the Heater (nm) |
|---|---|---|
| 25 | $1.74\times10^{6}$ | 43 |
| 100 | $0.55\times10^{6}$ | 38 |
| 200 | $2.57\times10^{4}$ | 27 |
| 250 | $8.00\times10^{2}$ | 30 |
| 300 | $11.6\times10^{7}$ | 48 |
| 400 | $8.05\times10^{7}$ | 37 |

The steady decrease in particle concentration and size as temperature is increased from 25° C. to 250° C. indicate sublimation of solid carbon dioxide particles inside the heater. The 5 order of magnitude increase in particle concentration and relative increase in size at 300° C. and 400° C., and absence of significant difference in those measurements between the two temperature levels suggest that the measurements corresponds to TBADN particles generated by introduction of carbon dioxide particles below the surface of molten film of TBADN on the heater wall as TBADN coating on heater wall is expected to melt above 289° C.

Example 2

Figure 2A:
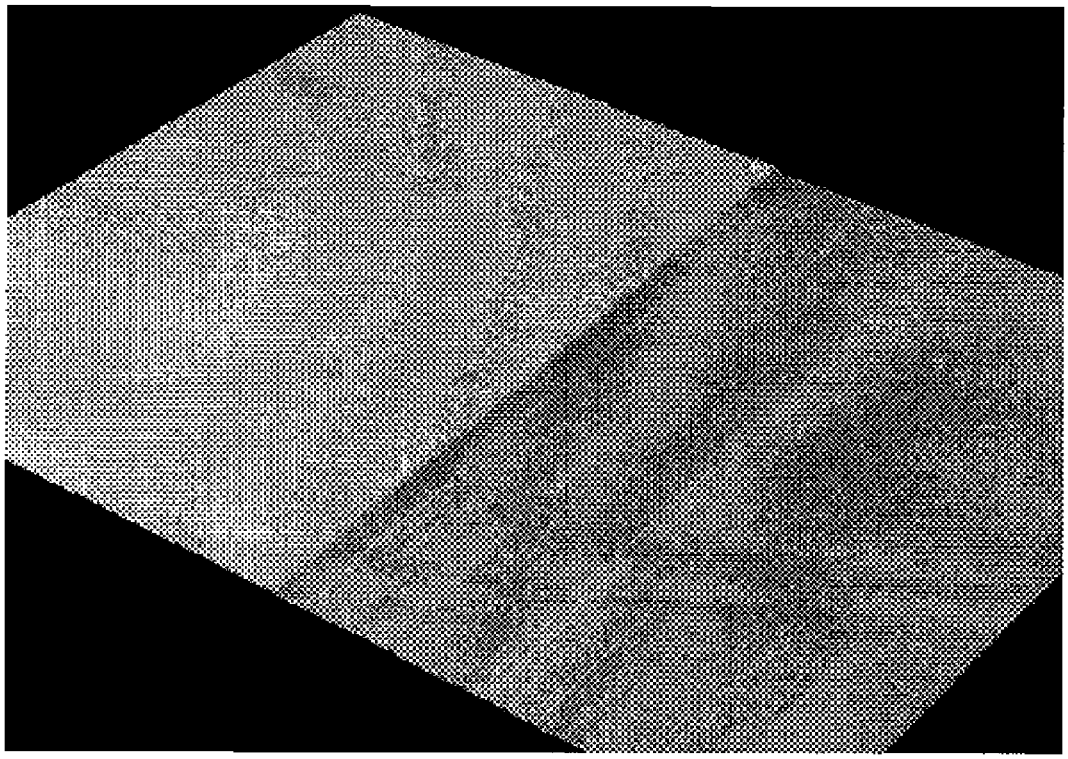
FIG. 2(A) is a 3-dimensional display of the sample surface obtained in Example 2.
Figure 2B:
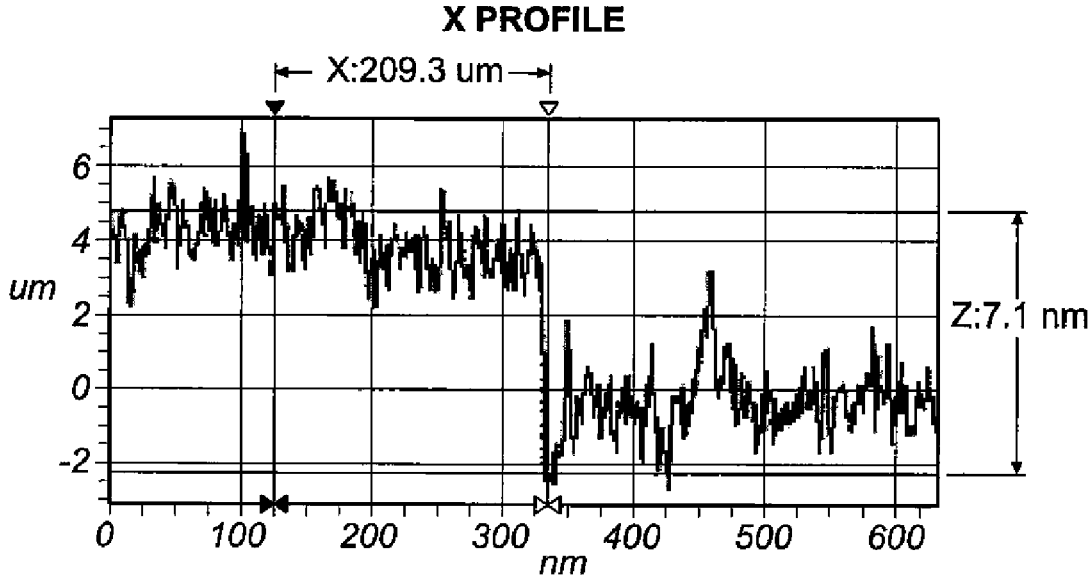
FIG. 2(B) is a plot of a WYKO NT8000 instrument signal near a carefully created edge on the sample surface obtained in Example 2.

The procedure outlined in Example 1 was repeated to deposit the material exiting the heater by allowing it to impinge onto a glass plate 0.3 inches away, and moved back and forth 50 times at constant speed of 0.5 ft/min along a single axis. A different glass plate was used for different value of heater wall temperature. There was little or no film formation when heater wall temperature was below 250° C. However, above the melting point of TBADN, the film formation was evident from photoluminescence of the film under 365 nm light exposure. FIG. 2(A) is a 3-dimensional display of the film obtained when the heater wall temperature was 400° C. The gas stream temperature at the heater exit was about 250° C., and the deposition temperature on glass slide was less than 90° C. This deposition temperature is substantially less than the bulk melting point of TBADN. The TBADN film had been coated with 2 nm thick gold film under vacuum and examined by Vertical Scanning Interferometry with a non-contact optical profilometer (WYKO NT8000 from Veeco Instruments). FIG. 2(B) shows the instrument signal near the carefully created edge on the deposition surface. The lower level of the signal corresponds to the glass slide surface. The higher level corresponds to the deposited layer. It shows a nominal layer thickness of 7.1 nm, and a layer that is also continuous.

Example 3

Figure 3:
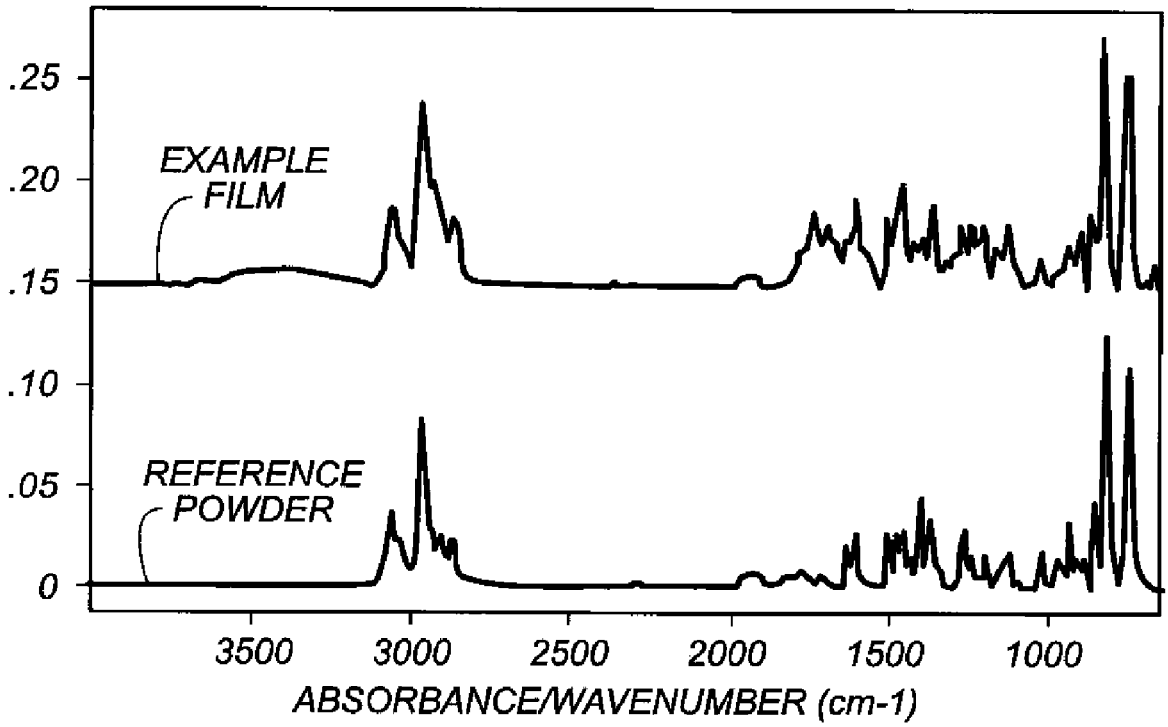
FIG. 3 is a plot of the Infra Red Spectra of the film obtained in Example 3.

The procedure described in Example 2 was repeated with a heater wall temperature of 500° C. The resultant film was analyzed with Infrared spectroscopy. The spectra were generated using the Nic/Plan infrared microscope interfaced to the Magna 550 spectrometer. Spectra were collected in transmission mode. FIG. 3 shows that the IR spectra of the TBADN film are similar to the reference TBADN powder. The few extra peaks from the film spectra may be attributed to differences in thin film structure compared to the bulk.

Example 4

Figure 4A:
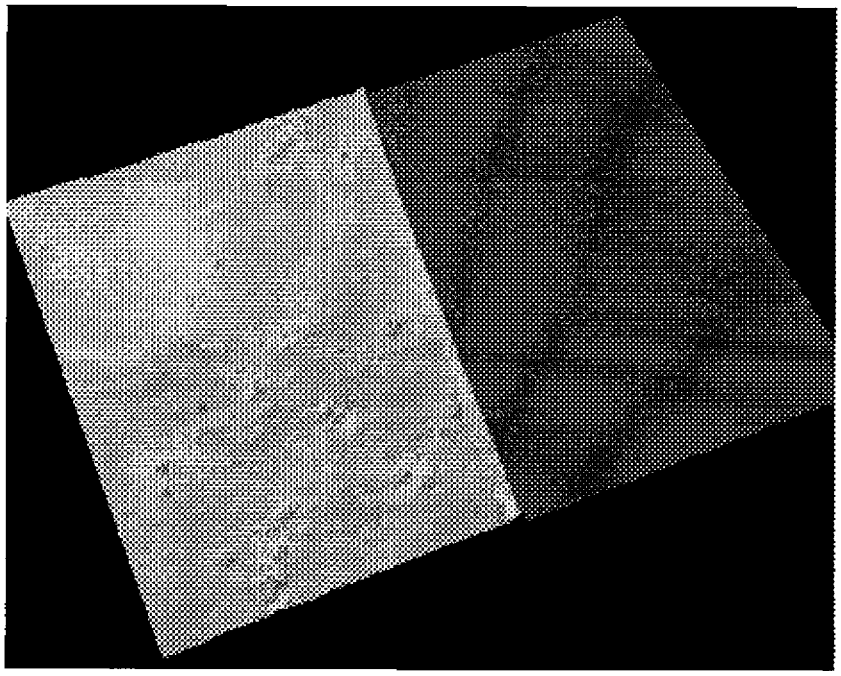
FIG. 4(A) is a 3-dimensional display of the sample surface obtained in Example 4.
Figure 4B:
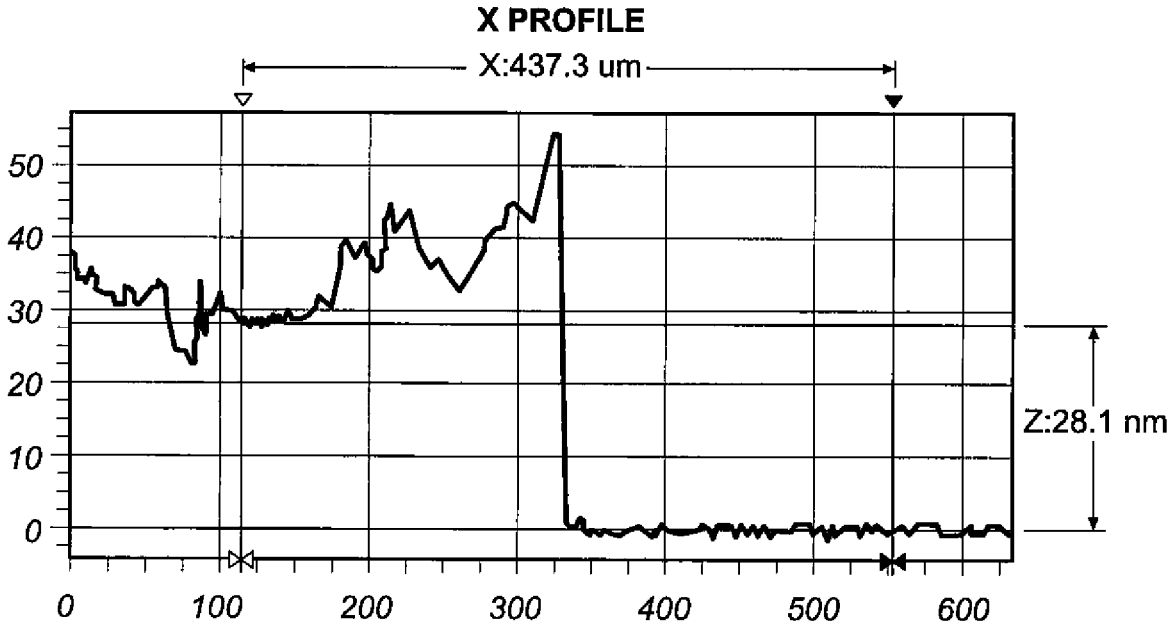
FIG. 4(B) is a plot of a WYKO NT8000 instrument signal near a carefully created edge on the sample surface obtained in Example 4.

The interior wall of a flow-through gas heater (Omega Inc., Model AHPF-101) was electroplated with a 20-micron film of elemental tin. The melting point of tin is 232° C. The vapor pressure of tin at 232° C. is $5.78\times10^{-26}$ Bar. The heater wall was kept at 375° C. and 100 g/min of carbon dioxide gas/solid mixture was fed into the heater in manner similar to previous examples. The outflow of the heater was allowed to impinge on a glass slide that was pre-coated with a 15 nm gold film. The glass slide was moved back and forth 200 times under the heater outlet port, at a constant speed of 76 cm/min. The temperature in the impingement zone of the substrate was 110° C., much less than the melting point of tin. The resultant film was analyzed for continuity and thickness by optical interferometry, analogous to previous examples. As shown in FIGS. 4 (A) and (B), a continuous film with an average thickness of 13 nm was found. X-ray Fluorescence measurements confirmed that the film contained tin.

Example 5

Figure 5A:
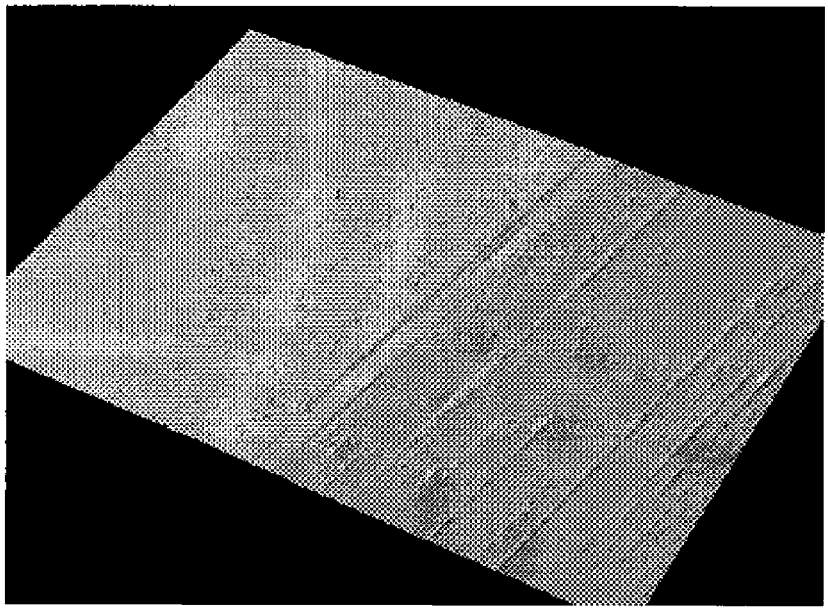
FIG. 5(A) is a 3-dimensional display of the sample surface obtained in Example 5.
Figure 5B:
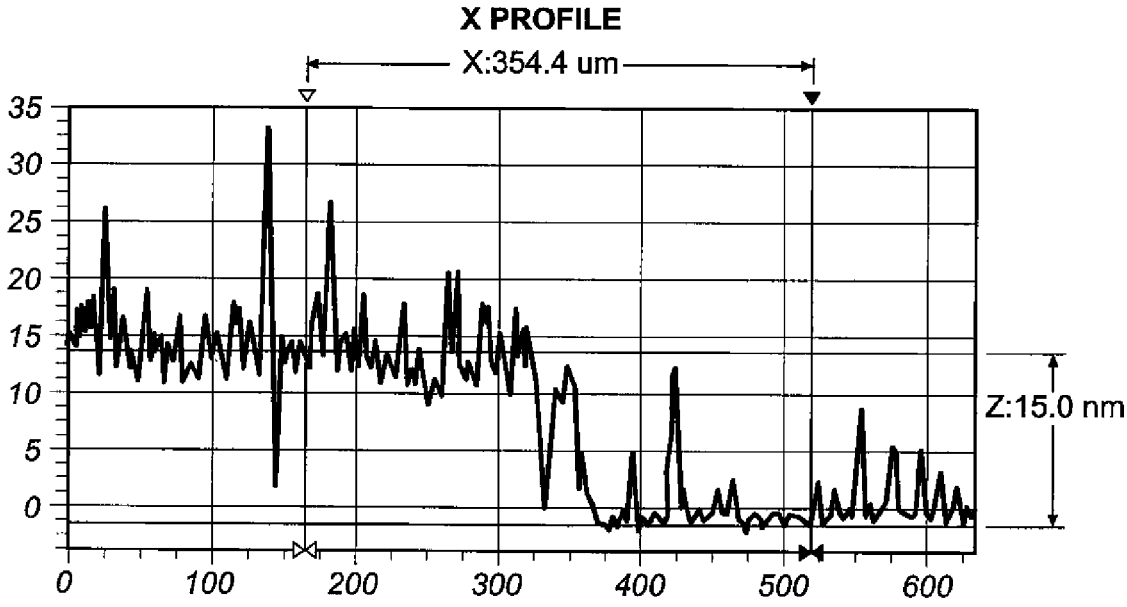
FIG. 5(B) is a plot of a WYKO NT8000 instrument signal near a carefully created edge on the sample surface obtained in Example 5.

A 250 ml standard laboratory glass flask was heated from the bottom with a laboratory hot plate (Corning PC-351). The flask was at atmospheric pressure. About 70 g of tin foil was cut into small pieces and melted under flowing carbon dioxide gas. Once the metal was fully melted, the temperature of the melt was controlled and the pressure profile of the $CO_2$ stream prior to its entry into the flask was altered such that it generated and carried copious amount of nanosized dry ice particles. With a combined flow rate of 40 g $CO_2$/min entering the flask, the carbon dioxide spray impinged directly on to the molten metal from a distance of about 7 cm. The flask was exhausted through a 3.5 mm internal diameter glass tube located about 10 cm above the melt surface. The outflow was then directed to a gold-coated glass surface in a manner similar to Example 4. X-Ray Fluorescence confirmed the resultant coating to contain tin. The tin film was examined by Vertical Scanning Interferometry with a non-contact optical profilometer (WYKO NT8000 from Veeco Instruments). FIG. 5 (A) is a 3-dimensional display of the sample surface obtained in Example 5. The lower level of the signal corresponds to the glass surface. The higher level corresponds to the Tin layer. FIG. 5(B) shows the instrument signal near the carefully created edge on the deposition surface. The lower level of the signal corresponds to the glass surface. The higher level corresponds to the deposited layer. It shows a nominal layer thickness of 15 nm, and a layer that is also continuous. After subtracting a 3 nm thickness of gold sub-layer, tin film thickness was measured to be ca. 12 nm.

Example 6

Figure 6:
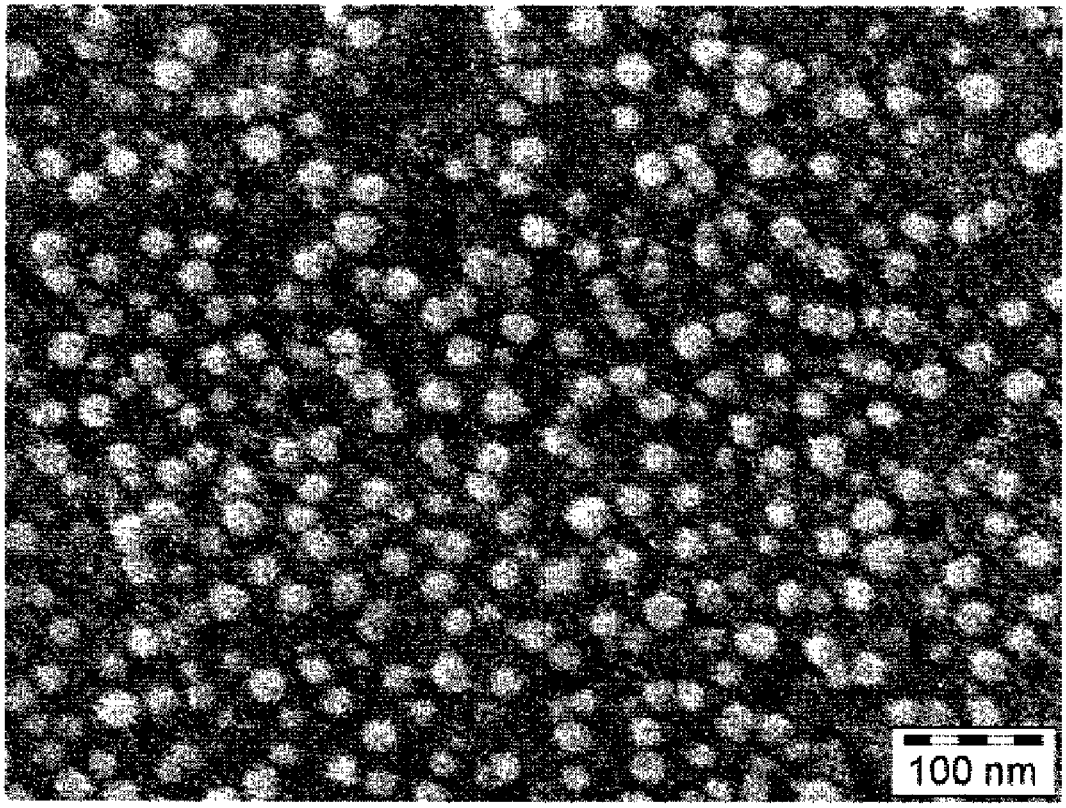
FIG. 6 is a Scanning Electron Micrograph of particles obtained in Example 6.

The procedure described in Example 5 for the generation of tin particles was repeated with the following exceptions: (1) The total flow rate of carbon dioxide was kept at 20 g/min, and (2) the exhaust tube was submerged into a volume of distilled water in a collection jar. After bubbling the exhaust stream through the collection jar for a period of 3 hours, the water in the collection jar was analyzed by X-ray fluorescence and found to contain 590 microgram tin/g of water. The tin-in-water dispersion was then examined under Scanning Electron Microscope. As shown in FIG. 6, a population of particles with diameter <40 nm was seen. Energy Dispersive Spectroscopy of the particles confirmed that the particles contained mostly tin.

Example 7

Figure 7:
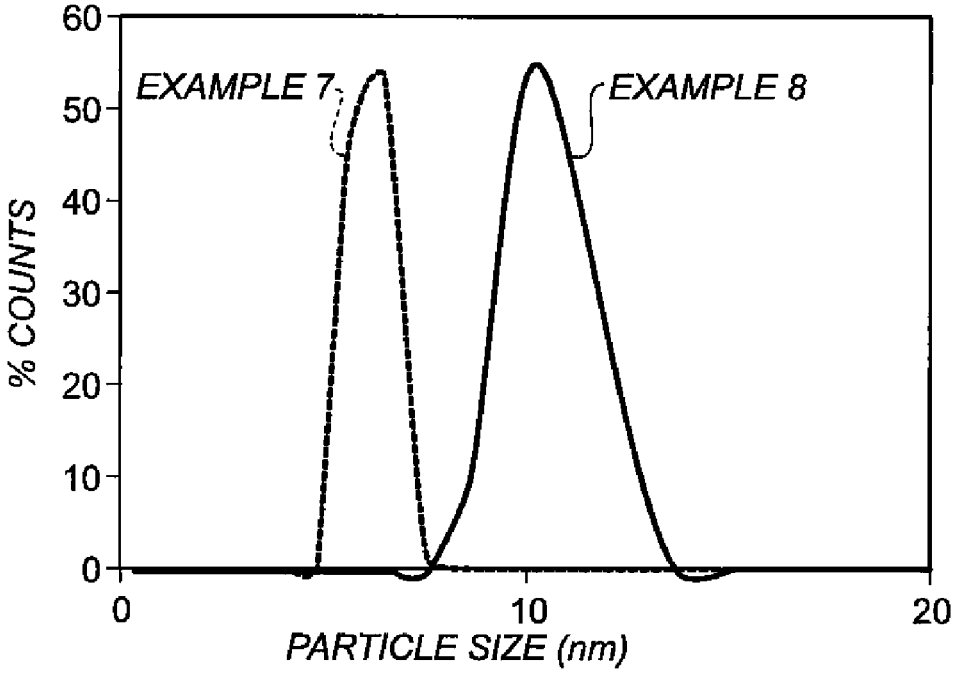
FIG. 7 is a graph of particle size distribution of particles obtained in Example 7 and Example 8.

The procedure described in Example 6 was repeated except that the collection jar contained standard roughing pump vacuum oil instead of distilled water. The particle size distribution was then measured with Photon Correlation Spectroscopy (Nano ZS; Malvern Instruments Ltd., U.K.). As shown in FIG. 7, a mean particle size of ca. 6.5 nm was measured.

Example 8

The procedure described in Example 6 was repeated except that the collection jar contained vacuum oil and dispersant Disperbyk® 182 (BYK Chemie). The particle size distribution was then measured with Photon Correlation Spectroscopy (Nano ZS; Malvern Instruments Ltd., U.K.). As shown in FIG. 7, a mean particle size of ca. 10.1 nm was measured.

These examples show that our invention enables the production and collection of nanoparticles of a target material while operating under ambient atmospheric pressure. Our invention further enables manufacturing of continuous films of these nanoparticles at temperatures below the bulk melting point of the target material. Our invention also enables manufacturing of dispersions of these nanoparticles.

It is to be understood that elements not specifically shown or described may take various forms well known to those skilled in the art. Additionally, materials identified as suitable for various facets of the invention are not limiting. These are to be treated as exemplary, and are not intended to limit the scope of the invention in any manner.

PARTS LIST

10 Particle formation and collection apparatus
20 Cryogenic material source
22 Cryogenic material particles
25 Stream containing cryogenic particles
30 Particle formation vessel
35 Optional heating element
40 Target material
45 Gas-liquid interface
50 Target material particles
55 Stream containing target material particles
60 Target material collection device

The invention claimed is:

1. A process for the formation and collection of particles of a target material comprising:

(i) providing a particle formation vessel containing a liquid target material, wherein a continuous liquid surface is present at the interface of the liquid target material and additional gaseous contents of the particle formation vessel, and an interface between said liquid surface of the target material in a liquid state and additional gaseous contents of said particle formation vessel;

(ii) introducing a stream of cryogenic material containing particles of cryogenic material in cryogenic form into contact with the liquid target material below said interface in the particle formation vessel;

(iii) allowing rapid volumetric expansion of the particles of the cryogenic material into a gaseous state while in contact with the liquid target material in the particle formation vessel, and releasing the expanded gaseous cryogenic material through said interface while forming liquid droplet particles of the target material in the particle formation vessel; and (iv) collecting the formed particles of the target material.

2. A process according to claim 1, where the cryogenic material is carbon dioxide.

3. A process according to claim 1, where the target material comprises an organic compound.

4. A process according to claim 1, where the target material comprises a metal or metal alloy.

5. A process according to claim 1, further comprising exhausting a gaseous flow containing formed particles of the target material entrained therein from the particle formation vessel, and wherein the formed particles of the target material are collected from the gaseous flow.

6. A process according to claim 5, wherein the gaseous flow is directed to a liquid medium and the formed particles of the target material are collected in the form of a dispersion of the target material particles in the liquid medium.

7. A process according to claim 5, wherein the gaseous flow is directed towards a substrate and the formed particles of the target material are collected in the form of a coating on the substrate.

8. A process according to claim 7, wherein the coating on the substrate is a continuous film.

9. A process according to claim 8, wherein the continuous film is deposited at ambient or near ambient conditions of pressure.

10. A process according to claim 9, wherein the formed particles of the target material form a continuous film upon contact with the substrate at a temperature of the gaseous flow lower than the melting point of the bulk target material.

11. A process according to claim 5 wherein both cryogenic material and target material are introduced into the particle formation vessel at a rate substantially equal to the rate at which they are removed from it.

12. A process according to claim 1 where the formed particles of target material have an average size of less than 100 nm.

13. A process according to claim 1, wherein the stream of cryogenic material introduced in step (ii) comprises particles of cryogenic material having an average size of less than 100 nm.

14. A process according to claim 1, wherein the liquid droplet particles of the target material formed in step (iii) solidify before being collected in step (iv).

15. A process according to claim 1 where the stream of cryogenic material introduced in step (ii) includes solid particles.

16. A process according to claim 1 where the stream of cryogenic material introduced in step (ii) includes liquid particles.

17. A process according to claim 1, wherein said target material has a melting point of Tm, and said target material is heated in the particle formation vessel to a temperature above the target material's melting point to form the continuous liquid surface of the target material having an interface with the gaseous contents of said particle formation vessel.

18. A process according to claim 1, wherein the target material is introduced into the particle formation vessel in a liquid state.

19. A process according to claim 18 where the temperature of the target material is controlled in the particle formation vessel to keep it in a liquid state.

* * * * *

UNITED STATES PATENT AND TRADEMARK OFFICE

CERTIFICATE OF CORRECTION

PATENT NO. : 7,931,834 B2
APPLICATION NO. : 11/674291
DATED : April 26, 2011
INVENTOR(S) : Rajesh V. Mehta It is certified that error appears in the above-identified patent and that said Letters Patent is hereby corrected as shown below:

| Issued Patent | | Description of Error |
|---|---|---|
| **Column** | **Line** | |
| 10 | 14-20 | In Claim 1, delete "(i) providing a particle formation vessel containing a liquid target material, wherein a continuous liquid surface is present at the interface of the liquid target material and additional gaseous contents of the particle formation vessel, and an interface between said liquid surface of the target material in a liquid state and additional gaseous contents of said particle formation vessel;"<br><br>and insert -- (i) providing a particle formation vessel containing a liquid target material, wherein a continuous liquid surface is present at the interface of the liquid target material and additional gaseous contents of the particle formation vessel; -- |

Signed and Sealed this
Eighth Day of November, 2011

David J. Kappos

David J. Kappos
*Director of the United States Patent and Trademark Office*